United States Patent [19]

Lawler

[11] Patent Number: 5,058,085

[45] Date of Patent: Oct. 15, 1991

[54] RESETTABLE CHRONOMETER HAVING BIOLOGICALLY PERSONAL UTILITY

[76] Inventor: Marvin Lawler, 1240 Granville Ave. #5, West Los Angeles, Calif. 90025

[21] Appl. No.: 445,264

[22] Filed: Nov. 28, 1989

[51] Int. Cl.[5] ..... G04B 19/24; G04C 19/00

[52] U.S. Cl. ..... 368/28; 368/82

[58] Field of Search ..... 368/28-29, 368/82-84, 107-113, 239-242

[56] References Cited

U.S. PATENT DOCUMENTS 3,333,410 8/1967 Barbella ..... 368/29

4,005,571 2/1977 Wolff ..... 368/108

FOREIGN PATENT DOCUMENTS 53139571 5/1978 Japan ..... 368/28

*Primary Examiner*—Vit W. Miska

*Attorney, Agent, or Firm*—Chris Papageorge

[57] ABSTRACT

An electronic timepiece includes a microcontroller with timer functions for providing an output indicative of elapsed time from a selected start time. The timepiece includes a display panel displaying the elapsed time in minutes, hours, days, weeks, months and years. The output time divisions are arranged so that the year and month divisions are of the same length. This allows the user who may, for example, be trying to quit smoking, to monitor his progress with personally relevant information provided by the chronometer and thereby enables the user to personally interact with the chronometer feedback in order to enhance the user's likelihood of achieving the desired goals. The chronometer includes start, stop, general display reset and individual display indicator set controls.

5 Claims, 5 Drawing Sheets

RESETTABLE CHRONOMETER HAVING BIOLOGICALLY PERSONAL UTILITY

BACKGROUND OF THE INVENTION

The invention relates generally to chronometers and more particularly to a chronometer which indicates elapsed time in minutes, hours, days, weeks, months and years. The chronometer is designed to indicate the elapsed time in terms of an easily understandable time division arrangement in order to provide elapsed time indication with which the user can emotionally interact so that it has a uniquely personal (and human) relevance to the user.

For athletic sporting events as well for many other applications, it is desirable to have a device which can indicate to the user the elapsed time from a given or desired start time, rather than actual time based on an established standard, such as, for example, Greenwich mean time. Consequently, many devices have been designed which indicate elapsed seconds, fractions of seconds, minutes and sometimes hours. Such devices often indicate elapsed time to a high degree of accuracy depending on the particular application.

Many modern timepieces have features which indicate both actual time in terms of minutes, seconds and hours as well as month and day of the month or day of the week. U.S. Pat. No. 4,320,476 to Berney is an example of a modern wristwatch type of timepiece which controls and drives the day of the month display in addition to indicating actual time.

Some prior art timepieces combine elapsed time capabilities with actual time capabilities in order to provide more versatility to the timepiece. An example of a conventional watch with stopwatch features is disclosed in U.S. Pat. No. 4,223,526 to Tanaka. The Tanaka device indicates actual time and, in response to switch actuation, converts to a stopwatch indicating seconds to a very high degree of accuracy.

Some timepieces have been specifically designed to indicate elapsed calendar time in order to fill a particular specialized need. An example of such a timepiece is disclosed in U.S. Pat. No. 4,630,935 to Zettek. The Zettek device has both a circuit for counting and a window for displaying the number of days since the initiation of a goal objective. However, a primary disadvantage of the Zettek device is that it is limited to indicating only elapsed days.

Another example of a prior art timepiece indicating elapsed time is disclosed in U.S. Pat. No. 4,527,906 to Jezbera. The Jezbera is a time indicator that counts and displays the number of days that have elapsed since the beginning of a woman's menstrual period. Thus, the Jezbera timepiece is of particular use to women who practice the rhythm method of birth control. However, as with the Zettek device, a primary limitation of the Jezbera device is that it counts only elapsed calendar days. Consequently, since the Jezbera device as well as the Zettek device do not have elapsed hour, minute and other elapsed calendar time capabilities, they are very limited in the practical applications in which they may be used.

A chronometer is thus needed that can count and indicate both elapsed horological and elapsed calendar time. An elapsed time chronometer is also needed that can be used in many different types of applications which require a count and indication of elapsed time.

SUMMARY OF THE INVENTION

It is a principal object of the present invention to provide an improved chronometer which indicates elapsed horological and calendar time.

It is another object of the present invention to provide an improved chronometer which is specifically designed for personal use by facilitating the achievement of desired goals.

It is also another object of the present invention to provide an improved chronometer which has elapsed calendar time features which include indication of elapsed days, weeks, months and years.

It is also an object of the present invention to provide an improved elapsed time chronometer in which the elapsed calendar time functions include particular calendar time divisions selected to facilitate personal use.

It is an object of the present invention to provide an improved elapsed time chronometer in which the elapsed calendar time functions include particular calendar time divisions selected to enhance simplicity of use.

It is an object of the present invention to provide an improved elapsed time chronometer which is of a size and shape to promote portability in order to facilitate personal use.

It is still another object of the present invention to provide an improved elapsed time chronometer in which the functions are resettable.

The chronometer of the present invention is specifically designed for use by an individual who desires to monitor his progress toward achievement of a set goal although it may also accomodate use by a group of individuals who share a common goal. The chronometer of the present invention provides a device with which the individual may interact on a more personal level by allowing the individual to visualize his progress toward a desired goal. Since the present invention displays the elapsed time since the initiation of a desired goal, the user can visualize his progress toward that goal and can also be reminded of his progress toward that goal in order to reinforce his desired behavior.

The chronometer of the present invention provides an accurate readout of the elapsed time by starting all the elapsed time division functions from the initiation of the goal objective i.e., these functions start from zero. Thus, the user gets an assessment of the elapsed horological (hour time division) and calendar (days, weeks, months or years) time. The elapsed time is provided in conformance with the novel time division arrangement of the present invention in which the conventional Gregorian calendar month is replaced by a fifth time division (or personal calendar month) and in which the conventional Gregorian calendar year is replaced by a sixth time division (or personal calendar year). The elapsed time is preferably provided in terms of the total accumulated minutes, hours, days, weeks, personal calendar months and personal calendar years from the initiation of the objective without reference to any other clock or any other calendar. Use of a conventional calendar might give an erroneous indication of the elapsed time because the division of the calendar days, months and years into minutes and hours must be taken into consideration in order to arrive at a true and accurate determination of the elapsed time. For example, if an individual initiating a goal objective at 11:59 P.M. on January 1 used an ordinary calendar at 12:01 A.M. January 2 to assess his progress, the use of only the calendar would yield a result of one day progress toward that goal whereas the true elapsed time is merely 2 minutes. Thus, the user would thereby obtain an erroneous assessment of his progress toward the desired goal. Continuation of such use of an ordinary calendar in the assessment of progress toward a goal objective would also tend to complicate calculation of the true elapsed time.

If an individual continues in progress toward the achievement of a goal for periods longer than a low number of days, the use of an ordinary calendar for determination of the elapsed time since the goal's initiation tends to make the determination more complicated and thereby promotes uncertainty, confusion and inaccuracy. The resulting uncertaintly, confusion and inaccuracy is due to the fact that in assessing the elapsed time the individual must continually take into consideration the precise minute and hour of the goal initiation time in conjunction with the variability in the number of days and weeks in conventional calendar months and in conjunction with the variability (to a lesser extent) in the number of days and weeks in conventional calendar years. Consequently, by providing an accurate, instantly available readout of the elapsed time, the chronometer of the present invention obviates these drawbacks. Thus, the present invention provides biological utility to the user by providing a personal interaction between the user and the chronometer. The personal interaction helps integrate the desired goal achievement with the user's emotional make up and the user's subconscious expectations or mind set thereby enhancing the user's progress toward the desired goal by the chronometer's use of a time division arrangement (which has personal importance pertaining to the goal achievement) rather than a time division arrangment set by society for its own needs (for example, Gregorian calendar time division arrangment) or other time system (for example, Daylight Savings Time or Greenwich Mean Time) set by society for its own needs rather than the user's personal needs.

An additional feature of the invention is its utilization of a calendar time division arrangement selected to make the number of days in a personal calendar month, weeks in a personal calendar month, weeks in a personal calendar year and days in a personal calendar year all be even, whole numbers. In this arrangement, every personal calendar month has 28 days and 4 weeks and every personal calendar year has 48 weeks and 336 days (and 12 of these months). This provides more consistency in determination of elapsed time when expressed in terms of months and years. Thus, the user can accurately assess his progress because the time divisions are equal in contrast to the time divisions of a conventional calendar in which the months are not necessarily equal to each other and in which the years are also not necessarily equal to each other. Consequently, the user of the present invention knows that a personal calendar month's progress has a definitely known, precise meaning in contrast to the user of an conventional calendar in which a month's progress does not have a definitely known, precise meaning due to the variability in the mumber of days and weeks in such a calendar. Moreover, the time division arrangement of the present invention provides a simplified arrangment which obviates the need if utilizing a prior art chronometer which uses a conventional calendar system to calculate elapsed time by defining an average month as having 4 and $\frac{1}{3}$ weeks and 30 and 2/5 days. Thus, the chronometer eliminates the need to use fractions in the calculation of elapsed time thereby facilitating quick and accurate assessment of elapsed time results.

The time division arrangement of the present invention includes six time divisions. The first time division has 60 seconds, equivalent to a conventional minute time division. The second time division has 60 minutes, equivalent to a conventional hour time division. The third time division has 24 hours, equivalent to a conventional day time division. The fourth time division has 7 days, equivalent to a conventional week time division. The fifth time division has 28 days (or 4 weeks). The sixth time division has 336 days (or 48 weeks).

The chronometer of the present invention has important application where an individual desires to give up an undesired habit such as smoking cigarettes or drinking alcoholic beverages. The chronometer of the present invention has a display panel which allows the user to see how long he has been without a cigarette or alcoholic beverage and allows him to continually monitor how long it has been since he gave up the habit. Thus, the user can visualize his progress toward the achievement of the goal and thereby obtain personal satisfaction by seeing (on the chronometer's display panel) to what degree he has succeeded in achieving the desired goal. Consequently, the user can obtain positive reinforcement of his efforts in giving up cigarettes or alcohol thereby making achievement of his goal more likely. The chronometer of the present invention also has the needed characteristics of providing a simple, easy to use device which can give an easily assessed indication of elapsed time from any desired initiation time.

DETAILED DESCRIPTION OF THE PREFERRED EMBODIMENT

Figure 1:
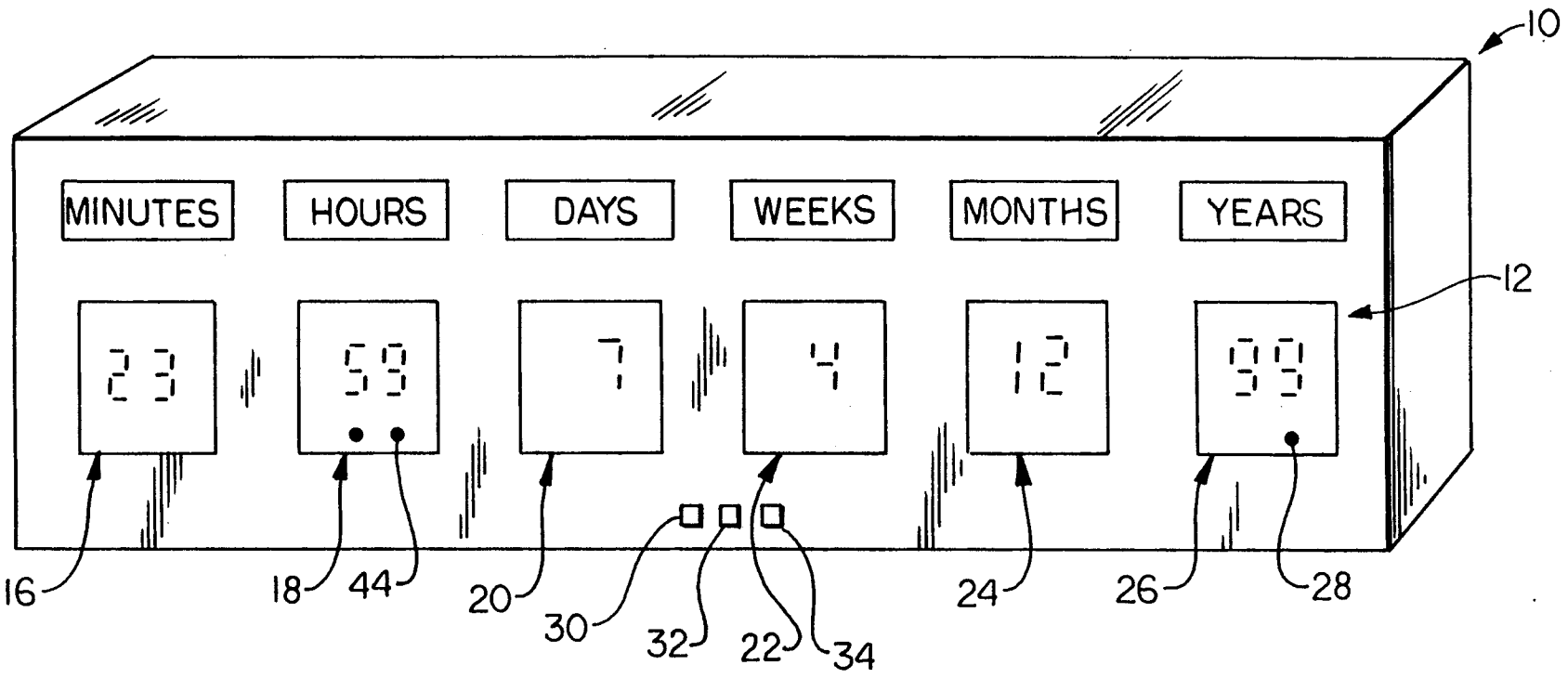
FIG. 1 is a perspective view of the chronometer of the present invention showing the display panel and control switches.

Referring to the drawings, FIG. 1 shows the chronometer of the present invention generally designated by the numeral 10. As shown in FIG. 1, the chronometer 10 preferrably has a display panel 12 (preferably approximately 8 inches by 3 inches) having display windows (or indicators) generally designated by the numeral 14 for preferably numerical display of the elapsed time. A first window 16, which is preferably located near one side of the panel 12, displays elapsed minutes. A second window 18, preferably located next to the window 16, displays elapsed hours. A third window 20, preferably located next to the window 18, displays elapsed days. A fourth window 22, preferably located next to the window 20, displays elapsed weeks. A fifth window 24, preferably located next to window 22, fifth time division units, or personal calendar calendar months. A sixth window 26, preferably located next to window 24, sixth time division units, or personal calendar years. Optionally, there may also be a seventh window (not shown) which displays an accumulated total of hours just as window 18 but additionally accumulated hours up to and in excess of 24 hours. The seventh window may display four or five digits and may also be located on the panel 12 so that the accumulated hours may be easily observed by the user.

FIG. 1 also shows the control switches 30, 32 and 34 which are preferably manually actuable and preferably located on the display panel 12 providing easy access to the switches for the user. Actuation of switch 30 starts the elapsed time counting function of the chronometer 10. Actuation of switch 32 stops the elapsed time counting function of the chronometer 10. Switches 30 and 32 are preferably an alternate action switch. Actuation of switch 34 resets all the windows 16, 18, 20, 22, 24, and 26 to zero to enable commencement of the chronometer indicating (or counting) function anew. Switches 30, 32 and 34 may also be combined into a single control switch or other suitable type of control, if desired.

FIG. 1 also shows lights 44 (preferably LED type) which are preferably mounted on panel 12 preferably within window 18. Lights 44 preferably flash every second and indicate to the user that the chronometer 10 is working. Another light 28 (preferably LED type) is preferably mounted on panel preferably within window 26. Light 28 goes on to indicate to the user that the back up battery is low and will be described more in detail hereinbelow.

FIGS. *2a* and *2b* show the circuitry for the chronometer 10. Chronometer 10 circuitry preferably includes a microcontroller (or microprocessor) 36 which preferably includes both a ROM and a RAM. Microcontroller 36 and other integrated circuit chips as well as other circuitry components are interconnected preferably by data buses (preferably bi-directional). However, other types of suitable interconnectors are also used where appropriate. The microcontroller, other chips and other circuitry components have output pins or terminals. Each pin or terminal is designated by a "z" prefaced number. Chronometer 10 preferably includes a clock pulse source or clock generator 38 which is preferably an integrated circuit chip. The clock generator 36 is associated with and receives a signal from crystal oscillator 40 preferably having a frequency of approximately 4.194307 Mhz. Generator 38 divides the oscillator signal into a seconds pulse signal which it transmits to operational amplifier 42 in order to cause preferably LED indicator 44 to flash every second. Generator 38 also divides the oscillator signal into a minute pulse signal which it transmits via output pin z14 to microcontroller 36. Microcontroller 36 receives an oscillator signal from crystal oscillator 70 having an operational frequency of approximately 6 Mhz. Microcontroller 36 counts the pulse signals from generator 38 and transmits an information signal (preferably including a time count in terms of preferably minutes, hours, days, weeks, personal calendar months and personal calendar years) to display drivers 46 and 48. Display drivers 46 and 48 receive this information which is in binary form and decode it into a display form (a number). Display drivers 46 and 48 transmit this decoded information to indicators 14 to display the numbers in digital form. From microcontroller to display the count number on one or more of the appropriate indicators 14 and to incrementally advance one or more of the appropriate elapsed time display panel indicators 14 in order to periodically update the indicators 14. Alternatively, however, the microcontroller 36 may also be used to divide the clock generator 38 signal into second and minute pulses, if desired.

Start and stop switches 30 and 32 as well as set switches 50 (which individually set the display indicators to display the desired time digits) are connected to encoder switch chip 52. In response to depression of any of switches 50 encoder 52 sends an information signal to microcontroller 36 (via pins z16, z17, z18 and z19 and bus transmission lines D0 to D3 on chip 52 and via bus transmission lines D0 to D7 and pins z12 to z19 of microcontroller 36). Microcontroller 36 identifies which switch has been depressed and sends an information signal to display drivers 46 and 48 and from there to indicators 14 to advance the number displayed or otherwise do what the particular switches require. Encoder switch 52 is also communicatingly connected to decimal decoder 54 via pins z14 and z5. Decimal decoder 54 receives a binary signal and converts it a decimal number. Decimal decoder 54 is communicatingly connected to AND gate 56 via pins z12 and z3 which is in turn communicatingly connected to microcontroller 36 via pins z1, z2, z8 and z10.

The output from microcontroller 36 is also communicated via bus transmission lines D0 to D7 and pins z23 to z19 to pins z3, z4, z7, z8, z13, z14, z17 and z18 of address latch 58. Output from latch 58 is communicated via bus transmission lines A0 to A7 and pins z2, z5, z6, z9, z12, z15, z16 and z19 of latch 58 via bus transmission lines A0 to A2 to pins z5, z6 and z10 of drivers 46 and 48.

When reset switch 34 is depressed, a signal is transmitted to microcontroller 36 (via pins z22 and z4) to erase the count memory and to responsively send an information signal to generator 38 (via pins z21 and z3) to reset generator 38 and an information signal to display drivers 46 and 48 to, in response, send an information signal to indicators 14 to clear and reset the indicators 14.

Chronometer 10 is also provided with an auxiliary battery 60 for back up power in the event of main power failure or inadvertent disconnection from the main AC power source 64. Operational amplifier 62 is connected to battery 60 in order to monitor battery power and light LED 28 if battery 60 has a low state of charge in order to advise the user that battery replacement is warranted. Preferably, light 28 is illuminated if battery 60 has a sufficiently low state of charge to require replacement in approximately two weeks.

Figure 2A:
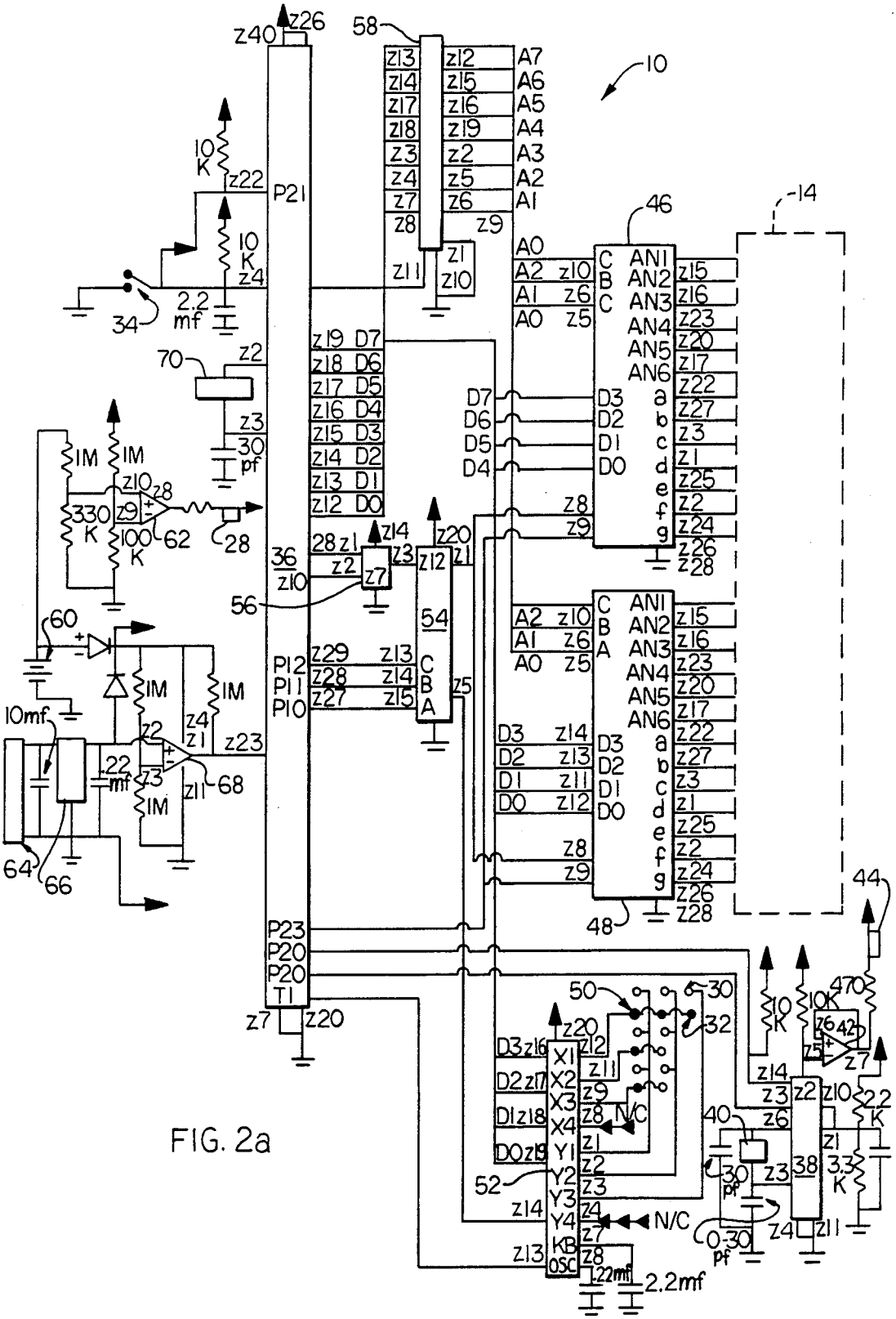
FIG. 2*a* is a block diagram of a major portion of the electronic circuits of the chronometer of the present invention.
Figure 2B:
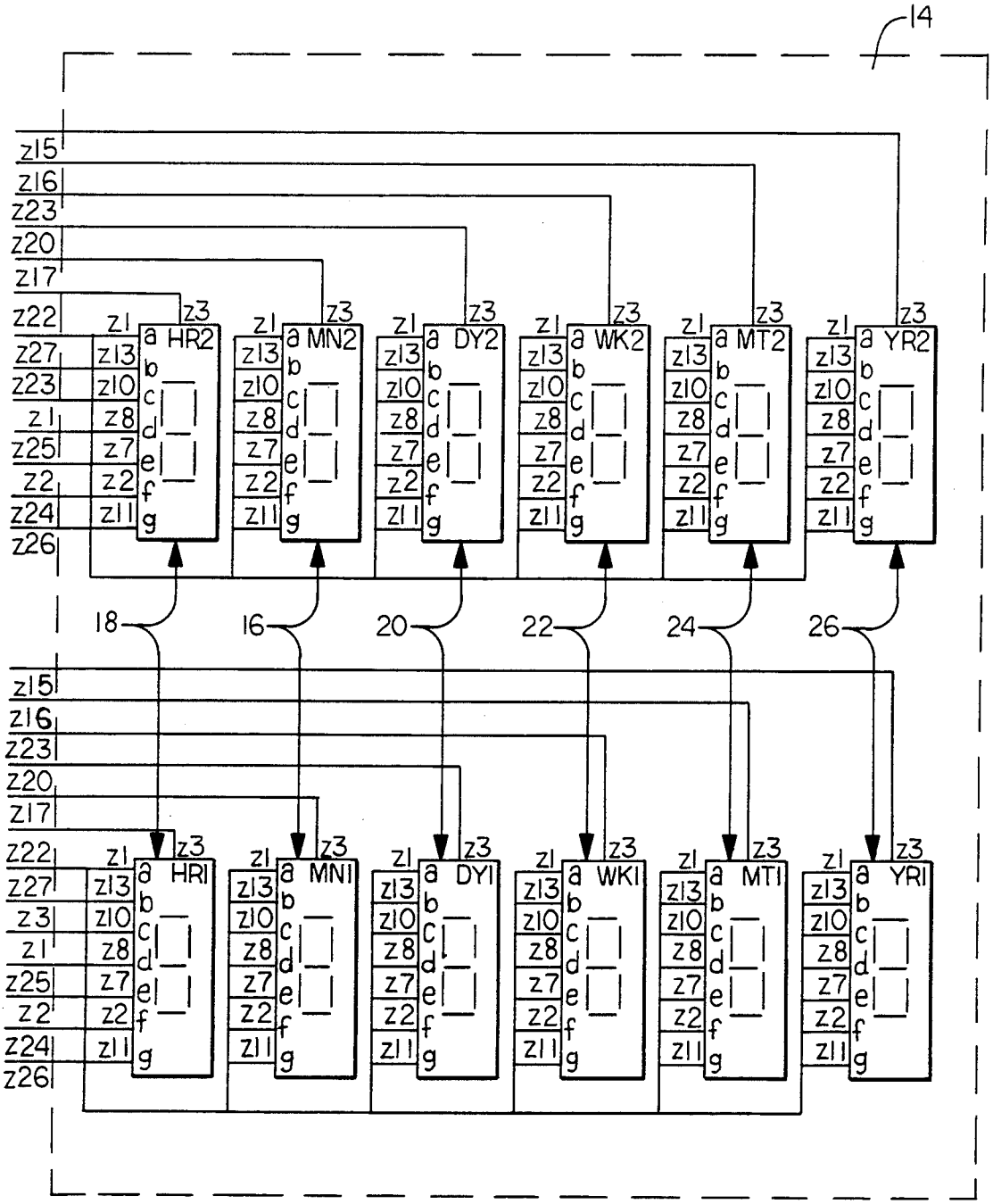
FIG. 2*b* is a block diagram of the display window portion of the electronic circuits of the chronometer of the present invention.

Voltage regulator 66 is used to receive the electrical power from the power source 64 and regulate it to provide an approximately 5 volt output to operational amplifier 68 and from there to the other circuitry components. As shown in FIG. 2, battery 60 is also connected to the amplifier 68 circuitry in order to provide electrical power to pin z23 of microcontroller 36 in the event electrical power output from voltage regulator 66 drops below a desired level.

Figure 3:
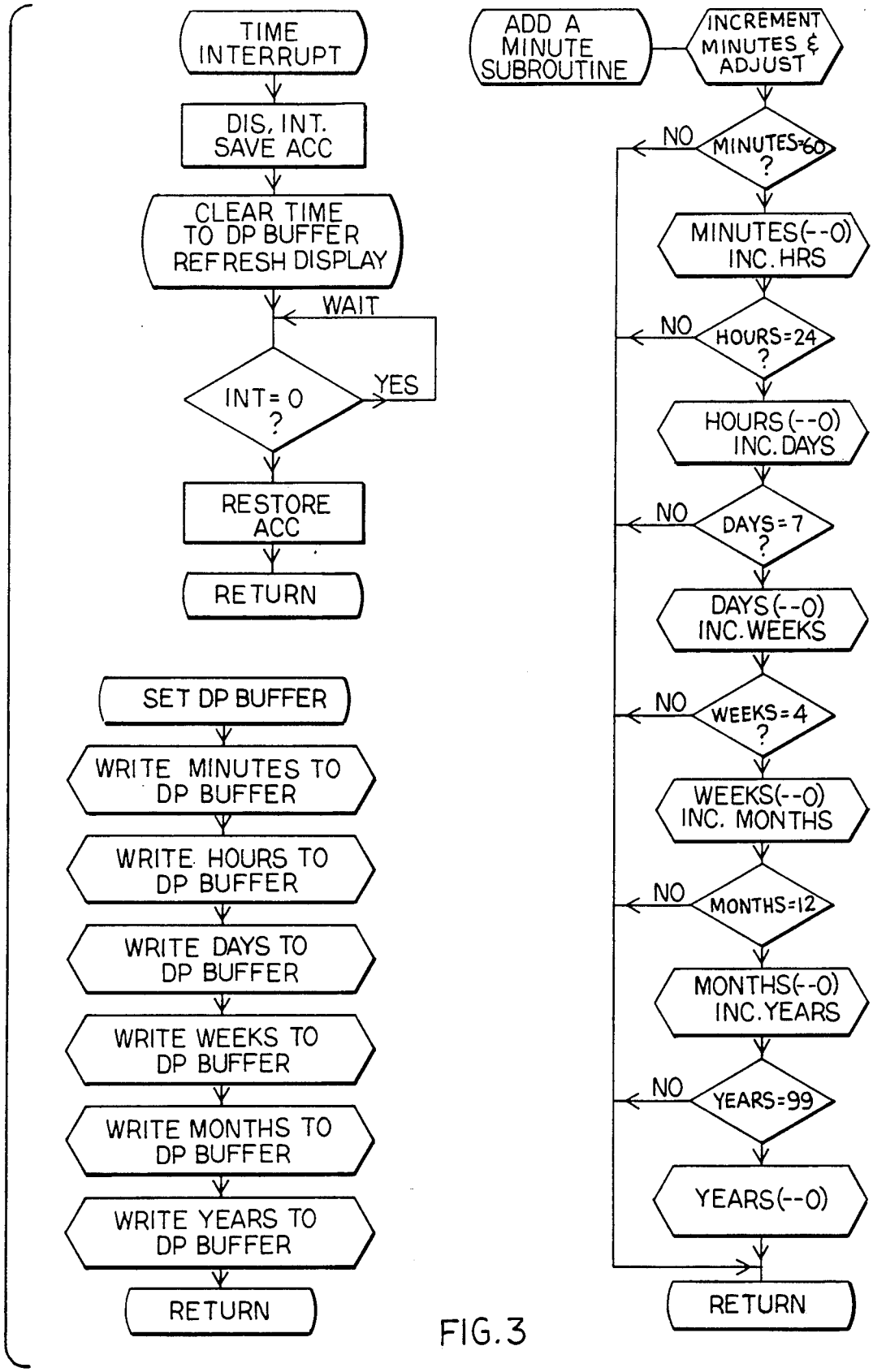
FIG. 3 is a flow chart showing the general elapsed time functional operation of the chronometer of the present invention as per the chronometer software program.

The flow diagram of FIG. 3 illustrates the functional operation of the chronometer 10 according to the program in the microcontroller 36. FIG. 3 generally shows the advancement of the display indicators to update the elapsed time readout. As shown in FIG. 3, initially the program subroutine adds a minute to the count in response to the clock generator signal or in response to the set time switches. The time division display indicators for hours, days, weeks, months and years are sequentially incremented as required by incrementation of the smaller time division indicators, as shown. Thus, the minutes display returns to zero upon reaching 60 at which point the hours display is incrementally advanced, the hours display returns to zero upon reaching 24 at which point the days display is incrementally advanced, the days display returns to zero upon reaching 7 at which point the weeks display is incrementally advanced, the weeks display returns to zero upon reaching 4 at which point the months display is incrementally advanced and the months display returns to zero upon reaching 12 at which point the years display is incrementally advanced. Optionally, the months display may be omitted so that the weeks display returns to zero upon reaching 52 at which point the years display is incrementally advanced.

FIG. 3 also shows the elapsed time indication function of the display panel. Information regarding the elapsed time is stored in the temporary memory of the display panel buffer before being transmitted to the display indicators to give the elapsed time readout.

FIG. 3 additionally shows time update functional operation. Timer functions are interrupted which also results in interruption of the display readout. The software command sequence subsequently clears time to the display buffer, refreshes the display and restores the timer functions after the sequence is over.

Figure 4:
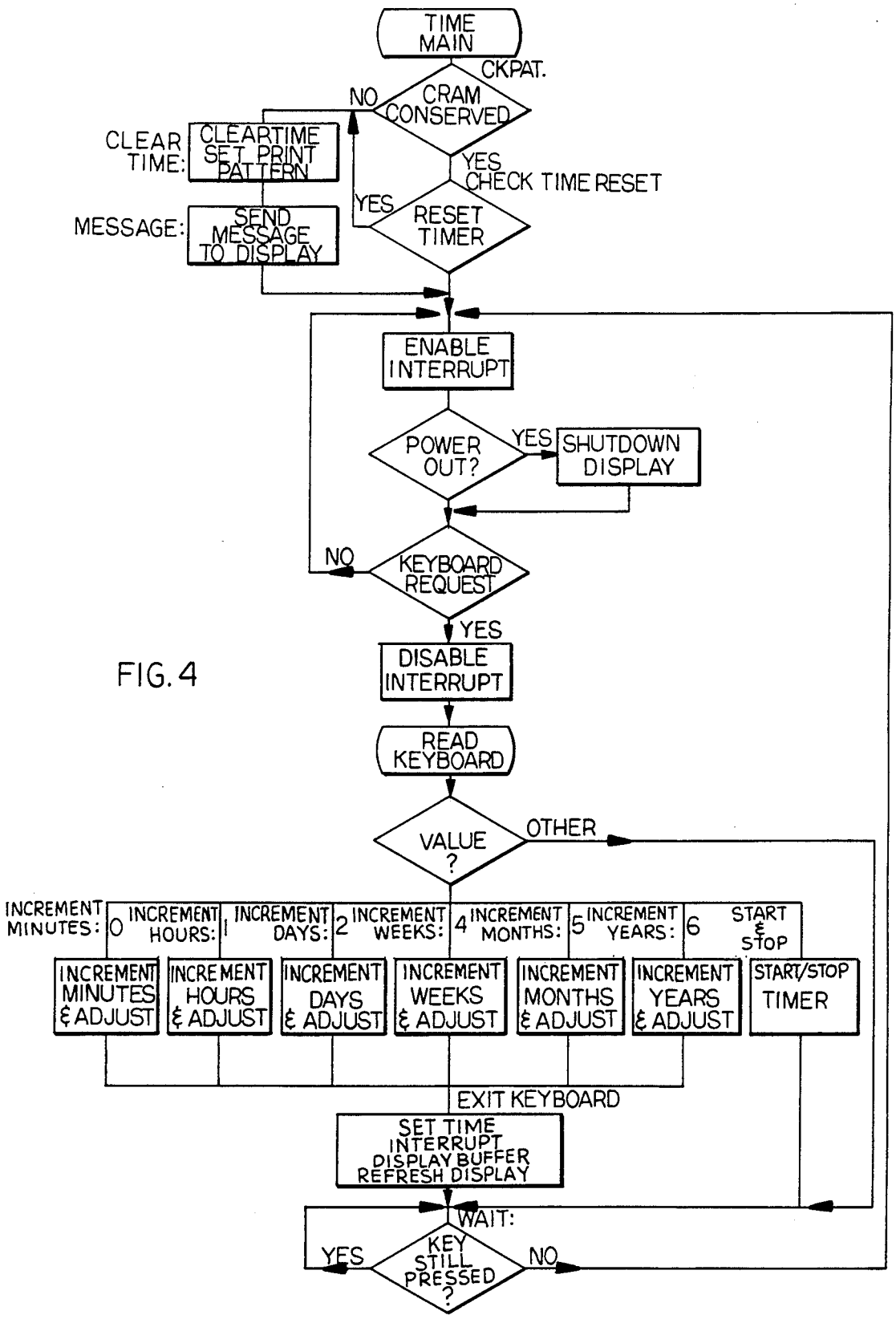
FIG. 4 is a flow chart showing the functional operation of the chronometer of the present invention when the keyboard controls are operated as per the chronometer software program.

FIG. 4 shows the functional operation of the chronometer under the main program. The main program checks the display print pattern and determines if the clock RAM is conserved in order to decide if the time readout should be cleared and the timer functions reset. The main program also has the special functions of individually incrementing and resetting the display indicators. In order to carry out these functions, the main program checks and determines if keyboard controls i.e., increment switches and stop/start switches, are being operated. If the controls are being operated, the program sets the time and performs the other functions of interrupting the display buffer and refreshing the display according to the keyboard control request.

Accordingly, there has been provided, in accordance with the invention, an elapsed time chronometer that fully satisfies the objectives set forth above. It is to be understood that all terms used herein are descriptive rather than limiting. Although the invention has been specifically described with regard to a microprocessor controlled chronometer, the invention may also utilize mechanical chronometer components. In addition, many alternative embodiments, modifications and variations will be apparent to those skilled in the art in light of the disclosure set forth herein. Accordingly, it is intended to include all such alternatives, embodiments, modifications and variations that fall within the spirit and scope of the invention as set forth in the claims hereinbelow.

I claim:

1. A chronometer which operates independently of any reference on going time keeping system, comprising:

a housing:

a clock oscillator;

a clock generator for converting output of said clock oscillator into a minute pulse signal output;

a display panel having a minutes display indicator, an hour display indicator, a day display indicator, a weeks display indicator, a fifth time division display indicator, and a sixth time division display indicator for numerically displaying elapsed time;

a microprocessor having a ROM which includes a software program which in response to the minute pulse output incrementally advances the minute indicator until reaching a count of sixty at which count the program reverts the minute indicator to zero and incrementally advances the hour indicator, the program in response to further minute pulse output advancing the hour indicator until reaching a count of twenty four at which count the program reverts the hour indicator to zero and incrementally advances the day indicator, the program in response to further minute pulse output advancing the day indicator until reaching a count of seven at which count the program reverts the day indicator to zero and incrementally advances the week indicator, the program in response to further minute signal output incrementally advancing the week indicator until reaching a count of four at which count the program reverts the week indicator to zero and incrementally advances the fifth time division indicator, the program in response to further minute signal output incrementally advancing the fifth time division indicator each time said week indicator reverts to zero until reaching a desired whole integer at which count the program reverts the fifth time division indicator to zero and incrementally advances the sixth time division indicator, so that the program provides the elapsed time generally in conformance with a selected calendar time division arrangement in which the time divisions are selected so that division of each of smaller time divisions thereof into successively larger time divisions thereof yields a quotient which is a whole integer;

a control for controlling said counter.

2. The chronometer of claim 1 wherein the selected time division arrangement includes a fifth time division comprising approximately 28 days.

3. The chronometer of claim 1 wherein the selected time division arrangement includes a sixth time division comprising approximately 48 weeks.

4. A chronometer which operates independently of any reference on going horological and calendar time keeping system, comprising:

a housing;

an oscillator;

a divider for converting output of said oscillator into desired minute pulse signal output;

a display panel having a minute display indicator, an hour display indicator, a day display indicator, a week display indicator, a fifth time division display indicator, and a sixth time division display indicator for numerically displaying elapsed time;

a microprocessor having a software program which in response to the minute pulse output incrementally advances the minute indicator until reaching a count of sixty at which count the program reverts the minute indicator to zero and incrementally advances the hour indicator, the program in response to further minute pulse output advancing the hour indicator until reaching a count of twenty four at which count the program reverts the hour indicator to zero and incrementally advances the day indicator, the program in response to further minute pulse output advancing the day indicator until reaching a count of seven at which count the program reverts the day indicator to zero and incrementally advances the week indicator, the program in response to further minute signal output incrementally advancing the week indicator until reaching a count of four at which count the program reverts the week indicator to zero and incrementally advances the fifth time division indicator, the program in response to further minute signal output incrementally advancing the fifth time division indicator until reaching a desired whole integer at which count the program reverts the fifth time division indicator to zero and incrementally advances the sixth time division indicator, so that the program provides the elapsed time generally conforming to a selected calendar time division arrangement which is selected so that division of smaller time divisions thereof into successively larger time divisions thereof yields a quotient which is a whole integer in order that counted time intervals of each of the time divisions are of equal length, said time divisions arrangement including a first time division consisting of approximately 60 seconds, a second time division consisting of approximately 60 minutes, a third time division consisting of approximately 24 hours, a fourth time division consisting of approximately seven days, a fifth time division consisting of approximately twenty eight days, and a sixth time division consisting of approximately three hundred and thirty six days;

a keyboard for manual control of said microprocessor, said keyboard, in response to manual operation thereof, providing input to said microprocessor to interrupt elapsed time counting function thereof, said keyboard, in response to manual operation thereof, providing input to said display panel to adjust numerical value thereof at commencement of the time counting function;

a main power source;

a back up power source;

a voltage regulator connected to said main power source, said back up power source, said microprocessor, and said display panel, said voltage regulator cutting off power to said display panel while allowing power from said back up power source in the event power supplied from the main power source drops below a desired level.

5. The chronometer of claim 1 wherein said control is manually operable.

* * * * *